United States Patent [19]

Main

[11] Patent Number: 5,035,116

[45] Date of Patent: Jul. 30, 1991

[54] APPARATUS TO ADAPT A WINDOW AIR CONDITIONING UNIT TO A SLIDING GLASS WINDOW SILL

[75] Inventor: Richard B. Main, Fremont, Calif.

[73] Assignee: Silicon Joule Corporation, Wilmington, Del.

[21] Appl. No.: 594,557

[22] Filed: Oct. 9, 1990

[51] Int. Cl.[5] ..... F25D 23/12

[52] U.S. Cl. ..... 62/77; 49/70; 49/168; 52/207; 62/262

[58] Field of Search ..... 62/262, 263, 77; 98/94.2; 52/207; 49/70, 168, 169

[56] References Cited

U.S. PATENT DOCUMENTS

| | | | |
|---|---|---|---|
| 2,925,026 | 2/1960 | Schuster et al. | 98/94.2 |
| 3,372,557 | 3/1968 | Dyas et al. | 62/262 |
| 3,415,074 | 12/1968 | Metcalfe | 62/262 |
| 3,464,158 | 9/1969 | Greene | 49/168 |
| 3,654,733 | 4/1972 | Blackwell | 49/168 |
| 3,811,224 | 5/1974 | Garrison | 49/168 |
| 4,229,905 | 10/1980 | Rush | 52/207 X |
| 4,760,872 | 8/1988 | Hale, Jr. | 49/168 X |

*Primary Examiner*—William E. Tapolcai
*Attorney, Agent, or Firm*—Richard B. Main

[57] ABSTRACT

An adaptor system for installing a window air conditioning (AC) unit mounted in a window case with a fixed window pane and a horizontally sliding window pane. The sliding window being made with a frame of an extruded metal stock, such as aluminum, fastened around a pane of glass, said frame constructed such that various sizes of sliding window panes can be custom made easily by cutting said extruded metal to length and reassembling around said pane of glass, said sliding window pane having latching means to secure said sliding window pane in a closed position to one side of said window case, said sliding window pane having latching means to secure an adaptor pane in a closed position to the same side of said window case intended to receive said sliding window pane, said adaptor pane having means to mate with the latching means of the sliding window pane, said adaptor pane having a horizontal dimension substantially the same as the width of the AC unit and having a vertical dimension substantially the height of the window case less the height of the AC unit, and means to guide the bottom of the adaptor pane in a horizontal sliding operation from side to side, the guiding means capable of being fastened to the top of the AC unit such that it parallels an equivalent channel at the top inside edge of the window case and such that the adaptor plane may slide in a manner that mimics the sliding window pane.

4 Claims, 2 Drawing Sheets

APPARATUS TO ADAPT A WINDOW AIR CONDITIONING UNIT TO A SLIDING GLASS WINDOW SILL

BACKGROUND OF THE INVENTION

1. Field of the Invention

The invention relates generally to air conditioning units, and more particularly to adapting window air conditioner units to sliding glass window sills.

2. Description of the Prior Art

Residential window-type air conditioning (AC) units, with rare exceptions, come equipped for mounting in window sills that have moving window panes that slide up and down ("hung" windows typically comprised of wood). These kinds of windows are very common in the Eastern United States and in the Mid-West, but houses built in California, and no doubt elsewhere in the last twenty years have sliding glass windows. A few of the window mounting AC units that are the exception to the rule, are intended to mount in "casement" windows. Casement windows have cranks and cranking the window causes a pane of glass to swing out on an axis along the side edge of the window unit.

Since the above window-type AC units are, as a rule, intended to mount in hung-window openings, sliding or pleated panels are included to close the gaps that exist between the AC unit and the sides of the window opening. The hung window is lowered to contact the AC unit and to form a seal.

FIG. 1 is a prior art hung-window AC unit installation, referred to by the general reference numeral 10. Installation 10 is comprised of a window case 12, a fixed window pane 14, a movable window pane 16, and an AC unit 18 having a left panel 20, a right panel 22, a top channel 24, and a bottom channel 26. To install AC unit 18 in window case 12, movable window pane 16 is lifted up to form an opening tall enough to accept panels 20 and 22 and channels 24 and 26. Channel 26 is installed to support AC unit 18 and to retain the bottom of panels 20 and 22. Channel 24 is mounted to the top of AC unit 18 and makes a weather proof seal between AC unit 18 and the bottom of movable window pane 16. Channel 24 also retains the tops of panels 20 and 22. Panels 20 and 22 are extended to either side to form weather proof seals with the sides of window case 12. Commercially available AC units 18 are typically sold with channels 24 and 26, together with panels 20 and 22. Instructions are included on how to accomplish an installation similar to installation 10.

SUMMARY OF THE PRESENT INVENTION

It is therefore an object of the present invention to provide an adapter for a window-type AC unit that fits the unit to a horizontally sliding glass window, such as those used in modern home construction in California.

It is a further object of the present invention to provide an adapter that is easy to install.

It is a further object of the present invention to provide an adapter that locks to a sliding glass window and its sill unit in a manner similar to the original manner of locking the sliding glass window to its sill unit.

Briefly, an exemplary embodiment of the present invention comprises a channel that mounts to the topside of an AC unit and a glass panel having a pair of spring latches.

An advantage of the present invention is that installation is simple and quick.

Another advantage of the present invention is that the home security is maintained because the sliding glass window is locked in place to the adaptor.

Another advantage of the present invention is that the sliding glass window can be unlatched from the adapter to allow fresh air in and to clean the outside surface of the adaptor.

These and other objects and advantages of the present invention will no doubt become obvious to those of ordinary skill in the art after having read the following detailed description of the preferred embodiments which are illustrated in the various drawing figures.

IN THE DRAWINGS

FIG. 1 is an elevational view from the inside of a house of a prior art window-type air conditioning unit mounted in a hung-window type window sill; and FIG. 2 is an elevational view from the inside of a house of an AC unit window adapter system built in accordance with the present invention which is shown installed in a sliding glass window case.

DETAILED DESCRIPTION OF THE PREFERRED EMBODIMENT

Figure 1:
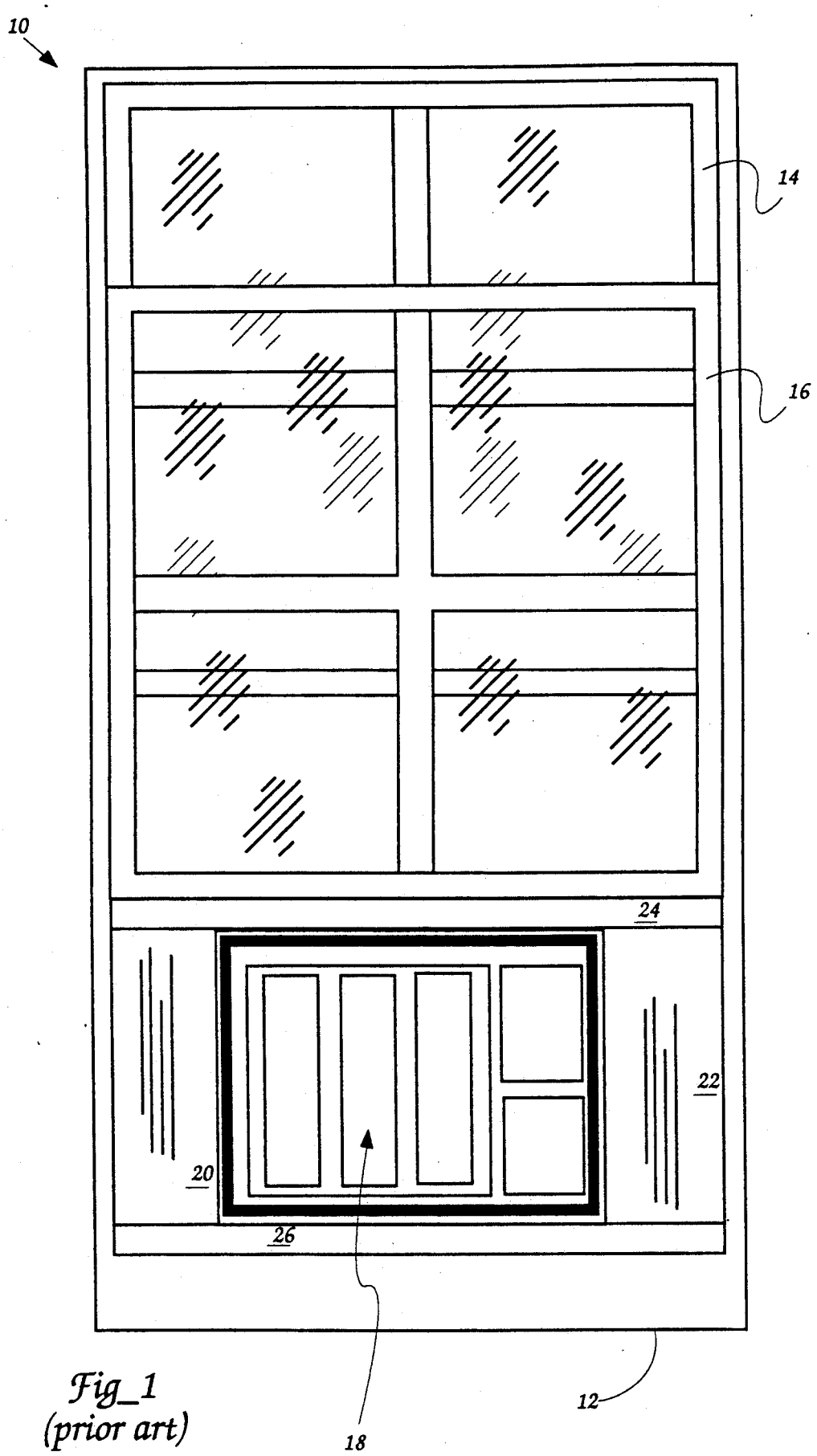
Fig 1 (prior art)
Figure 2:
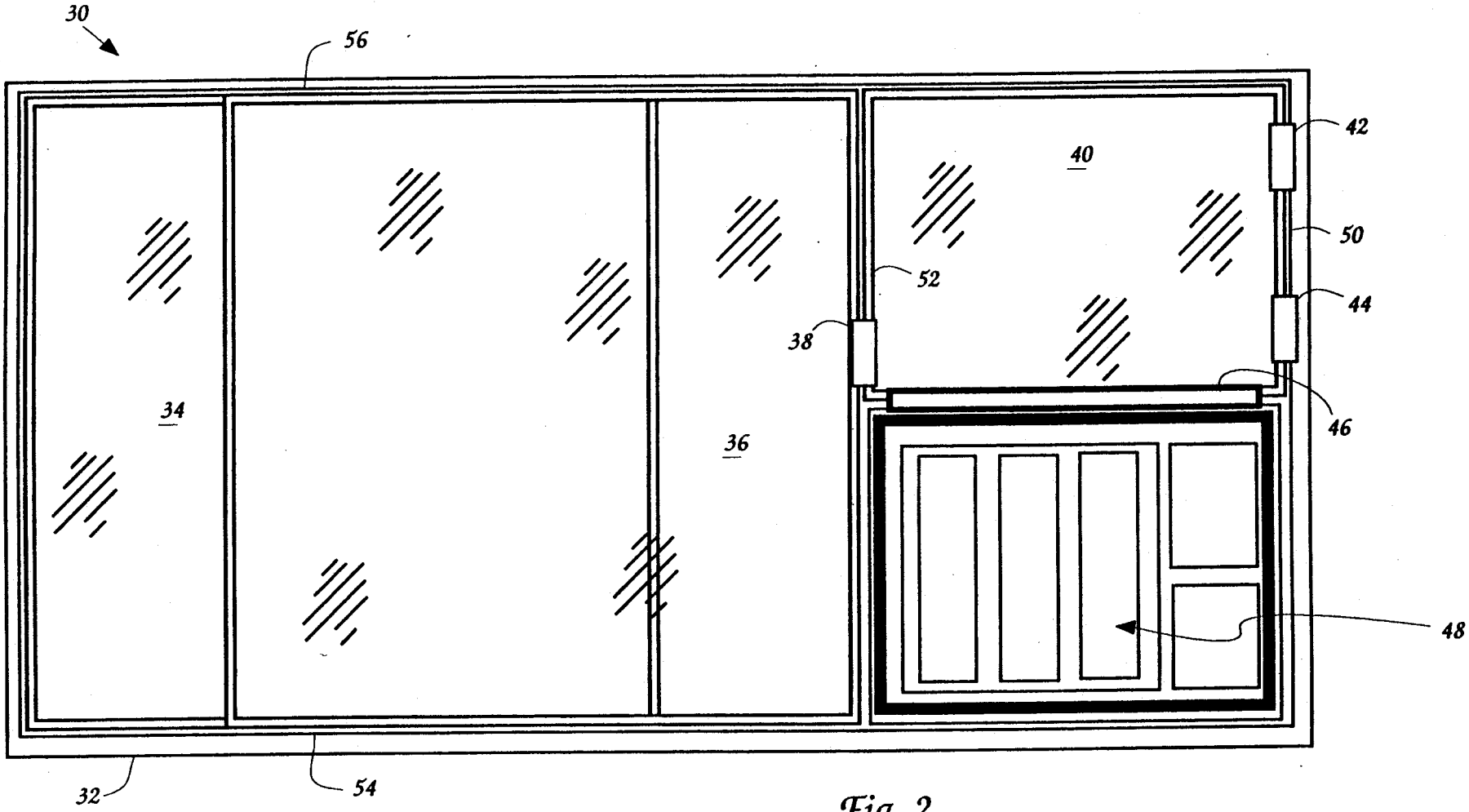

FIG. 2 is a sliding glass window AC unit installation, referred to by the general reference numeral 30. Installation 30 is an exemplary embodiment of the present invention and is comprised of a window case 32, a fixed pane 34, a sliding window pane 36 having a spring latch 38, an adaptor pane 40 having a pair of spring latches 42 and 44, an adaptor channel 46, and an AC unit 48. AC unit 48 is fastened to window case 32 at the bottom and right to keep it from falling out of window case 32 when sliding window pane 36 is opened. Latch 38 normally mates with a lip 50 on the right inside edge of window case 32 to securely close sliding window pane 36. Lip 50 has an adjacent channel that is sized to receive the leading edge of the right side of sliding window pane 36. A lip 52, which is substantially the equivalent of lip 50, is provided on the left side edge of adaptor pane 40. Lip 52 also has an adjacent channel, located in the left side of adaptor pane 40, that is sized to receive the leading edge of the right side of sliding window pane 36. Latch 38 is slid up in an extruded aluminum track at the right side of sliding window pane 36 to engage lip 52. Sliding window pane 36 can be moved to the left after operating latch 38 in the conventional manner. Sliding window pane 36 slides in a guide channel 54 that is inside the bottom length of window case 32. A similar guide channel 56 is provided along the top inside length of window case 32 for the same purpose. Adaptor pane 40 is a smaller copy of sliding window pane 36. The top edge of adaptor pane 40 fits into channel 56 and will slide in it in the same manner as does sliding window pane 36. Adaptor pane 40 has the two latches 42 and 44 that mate with lip 50 in the same way that latch 38 does. The right side leading edge of adaptor pane 40 inserts into the channel associated with lip 50 in substantially the same way as the leading edge of sliding window pane 36 does. The bottom edge of adaptor pane 40 slides horizontally in a guide channel within channel 46 that mimics guide channel 54. If latch 38 were not opened and latches 42 and 44 were, then sliding window pane 36 and adaptor pane 40 would be able to slide together as a unit to the left and right in their respective channels 54, 56, and 46. Preferably, adaptor pane 40 is constructed of the same materials as is sliding window pane 36. Typically, sliding window pane 36 will be comprised of a glass window pane surrounded by extruded aluminum pieces joined together at the corners by screws. For extra thermal insulation, the above window panes should preferably be at least two pieces of glass with air trapped in between. The construction is conventional and allows the assembly to be built of parts cut to the proper lengths and heights to fit a particular window case opening. However, window case 32 is available from several commercial sources in a variety of standard sizes. It would be feasible for an AC unit manufacturer, seller, or hardware store to stock adaptor panes 40 pre-assembled in sizes compatible with standard openings. An exemplary installation 30 will have the following dimensions in inches: window case 32=38"H×72"W, sliding window pane 36=38"H×36"W, adaptor pane 40=22"H×22"W, and AC unit 48=15"H×22"W.

As is obvious from the above discussion, an alternative embodiment possible is an installation 30 having AC unit 48 on the left hand side. All the corresponding elements above would be swapped left for right.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An adaptor system for installing a window air conditioning (AC) unit, said AC unit being mounted in a window case having a fixed window pane and a horizontally sliding window pane comprising a frame made of an extruded metal stock, said frame fastened around a pane of glass, said frame constructed such that various sizes of sliding window panes can be custom made easily by cutting said extruded metal to length and reassembling around said pane of glass, said sliding window pane having latching means to secure said sliding window pane in a closed position to one side of said window case, comprising:

a horizontally sliding adaptor pane comprising a frame assembled of an extruded metal stock, said frame fastened around a pane of glass, said frame constructed such that various sizes of sliding window panes can be custom made by cutting said extruded metal to length, said sliding adaptor pane having latching means to secure said adaptor pane in a closed position to the same side of said window case intended to receive said sliding window pane, the adaptor pane having means to mate with the latching means of the sliding window pane, the adaptor pane having a horizontal dimension substantially the same as the width of the AC unit and having a vertical dimension substantially the height of the window case less the height of the AC unit; and means to guide the bottom of the adaptor pane in a horizontal sliding operation from side to side, the guiding means capable of being fastened to the top of the AC unit such that it parallels an equivalent channel at the top inside edge of the window case and such that the adaptor plane may slide in a manner that mimics the sliding window pane.

2. The system of claim 1, wherein:

said panes of glass comprise at least two pieces of glass separated by and trapping a gas.

3. An air conditioning system, comprising:

a window-mounting type air conditioning (AC) unit capable of being mounted in a window case having a fixed window pane and a horizontally sliding window pane comprising a frame made of an extruded metal stock, said frame fastened around a pane of glass, said frame constructed such that various sizes of sliding window panes can be custom made easily by cutting said extruded metal to length and reassembling around said pane of glass, said sliding window pane having latching means to secure said sliding window pane in a closed position to one side of said window case, comprising:

a horizontally sliding adaptor pane comprising a frame assembled of an extruded metal stock, said frame fastened around a pane of glass, said frame constructed such that various sizes of sliding window panes can be custom made by cutting said extruded metal to length, said sliding adaptor pane having latching means to secure said adaptor pane in a closed position to the same side of said window case intended to receive said sliding window pane, the adaptor pane having means to mate with the latching means of the sliding window pane, the adaptor pane having a horizontal dimension substantially the same as the width of the AC unit and having a vertical dimension substantially the height of the window case less the height of the AC unit; and means to guide the bottom of the adaptor pane in a horizontal sliding operation from side to side, the guiding means capable of being fastened to the top of the AC unit such that it parallels an equivalent channel at the top inside edge of the window case and such that the adaptor plane may slide in a manner that mimics the sliding window pane.

4. A method of air conditioning installation in a window case having a fixed window and a horizontally sliding window, comprising the steps of:

constructing a smaller copy of the sliding window to fit an opening resulting from placing an air conditioner in a lower outside corner of the window case normally occupied by the sliding window, and resulting after sliding the sliding window tight to the side of the air conditioner opposite to said corner, said smaller copy including top and bottom edges to fit a pair of guide channels and a leading edge and latching means to mate with a receiving channel at one side of the window case, said smaller copy also including a receiving channel mimicking said receiving channel of the window case;

installing said air conditioner in said lower outside corner of the window case normally occupied by the sliding window;

mounting a guide channel to the top of said air conditioner parallel to a similar guide channel at the inside top of said window case and able to receive said smaller copy of the sliding window;

installing said smaller copy of the sliding window into said guide channel mounted on the top of said air conditioner and said similar guide channel at the inside top of said window case;

latching said smaller copy of the sliding window into said window case; and latching the sliding window into said smaller copy of the sliding window to seal out outside weather.

* * * * *